US006926274B1

(12) United States Patent
Portella

(10) Patent No.: US 6,926,274 B1
(45) Date of Patent: Aug. 9, 2005

(54) BOARD GAME HAVING AN INTEGRALLY ATTACHED ROTATING BOTTLE

(76) Inventor: Roger Portella, 166 Marlboro Rd., Brooklyn, NY (US) 11226

( * ) Notice: Subject to any disclaimer, the term of this patent is extended or adjusted under 35 U.S.C. 154(b) by 0 days.

(21) Appl. No.: 10/861,531

(22) Filed: Jun. 4, 2004

(51) Int. Cl.[7] ..... A63F 3/00
(52) U.S. Cl. ..... 273/141 R; 273/236; 273/243; D21/374
(58) Field of Search ..... 273/141 R, 236, 273/243; D21/374

(56) References Cited

U.S. PATENT DOCUMENTS 2,574,398 A * 11/1951 Krebeck ..... 273/141 R
3,633,915 A 1/1972 Lippert
3,863,925 A 2/1975 Torgow
6,467,770 B1 10/2002 Matosevic

FOREIGN PATENT DOCUMENTS

DE 29708277 U1 * 10/1997 ..... A63F 5/04

OTHER PUBLICATIONS

WO 99/38585 International PCT application published on Aug. 5, 1999.*

* cited by examiner

*Primary Examiner*—Vishu K. Mendiratta
(74) *Attorney, Agent, or Firm*—Goldstein Law Offices, P.C.

(57) ABSTRACT

A board game for providing hours of challenging and fun play, having a board having an interior, an integrally attached rotating bottle, and a plurality of instructional cards. The board game has a tubular base, having a top and bottom end, and an axis. The top end extends outwardly from the interior of the board, while the bottom end is located within interior of the board. A belt has two ends and is removably hooked at each end to the top end of the tubular base for securing the bottle to the tubular base. The bottom end of the tubular base is swivel mounted to the axis for allowing the bottle to rotate thereon.

3 Claims, 2 Drawing Sheets

BOARD GAME HAVING AN INTEGRALLY ATTACHED ROTATING BOTTLE

BACKGROUND OF THE INVENTION

The invention relates to a board game, and more particularly, to a board game having a board, an integrally attached rotating bottle, and instructional cards for providing hours of challenging and fun play.

For centuries, games have been a favorite pastime of adults as well as children. Games offer a reprieve from the stresses of daily life and encourage positive social and family interaction through good-natured competition. Board games are very popular among the elderly and disabled because only a limited amount physical exertion is required. Despite the increased attractiveness of electronic and computerized games, board games continue to be a very popular item.

U.S. Pat. No. 3,863,925 to Torgow discloses an amusement device comprised of a spinning top and a playing area with markings that can be used in a boy and girl kissing game. U.S. Pat. No. 3,633,915 to Lippert and U.S. Pat. No. 6,467,770 to Matosevic, disclose various games of chance having a spinning element.

While these units may be suitable for the particular purpose employed, or for general use, they would not be as suitable for the purposes of the present invention as disclosed hereafter.

SUMMARY OF THE INVENTION

It is an object of the invention to produce a board game for providing hours of challenging and fun play. Accordingly, the board game of the invention has a board, and an integrally attached rotating bottle for providing hours of challenging and fun play.

It is another object of the invention to provide a board game that is suitable for children and adults. Accordingly, the board game of the invention has a plurality of instructional cards each having a task thereon to be completed by a player on their turn, wherein each task is appropriate for adults as well as children.

This invention is a board game for providing hours of challenging and fun play, having a board having an interior, an integrally attached rotating bottle, and a plurality of instructional cards. The board game has a tubular base, having a top and bottom end, and an axis. The top end extends outwardly from the interior of the board, while the bottom end is located within interior of the board. A belt has two ends and is removably hooked at each end to the top end of the tubular base for securing the bottle to the tubular base. The bottom end of the tubular base is swivel mounted to the axis for allowing the bottle to rotate thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
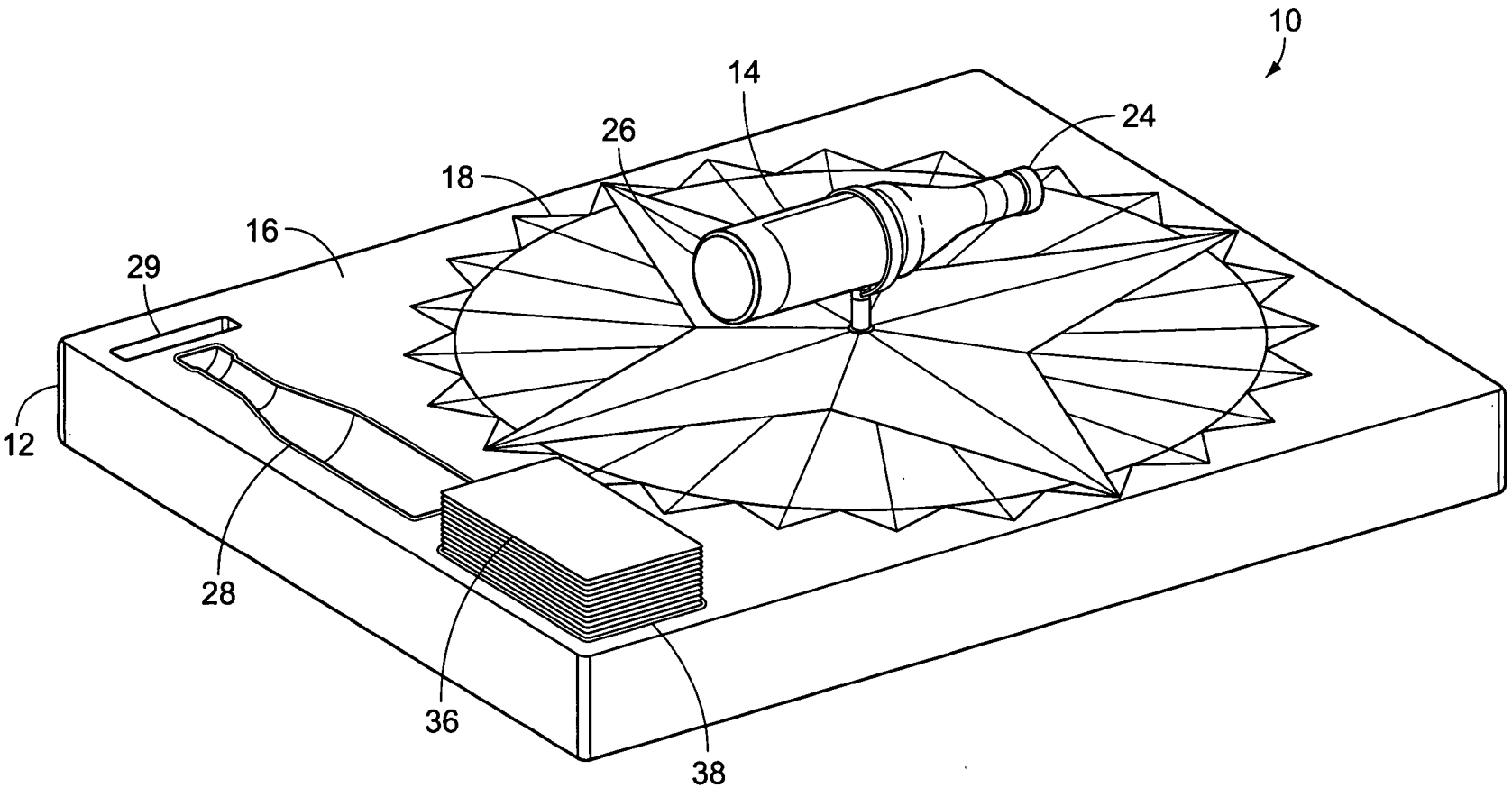
FIG. 1 is a diagrammatic perspective view of the board game of the present invention having a board, an integrally attached rotating bottle, and a plurality of instructional cards.

FIG. 1 illustrates a board game 10 of the present invention for providing hours of challenging and fun play. The board game 10 is made for players of all ages including adults as well as children, preferably 4 years of age and older. The board game 10 is played on any flat surface. The board game 10 has a board 12 that is substantially square in shape. The board game 10 also has a three-dimensional bottle 14 integrally attached to the board 12. The board 12 is preferably made of durable wood or plastic material, and measures approximately 20 inches in length, 20 inches in width, and 8 to 10 inches in depth. The board 12 includes a top surface 16 and an interior. The top surface 16 of the board 12 has a large circular, sun-like design 18 painted or etched thereon. The bottle 14 is preferably colored glass. The bottle 14 has a mouth 24 and a tail 26.

Figure 2:
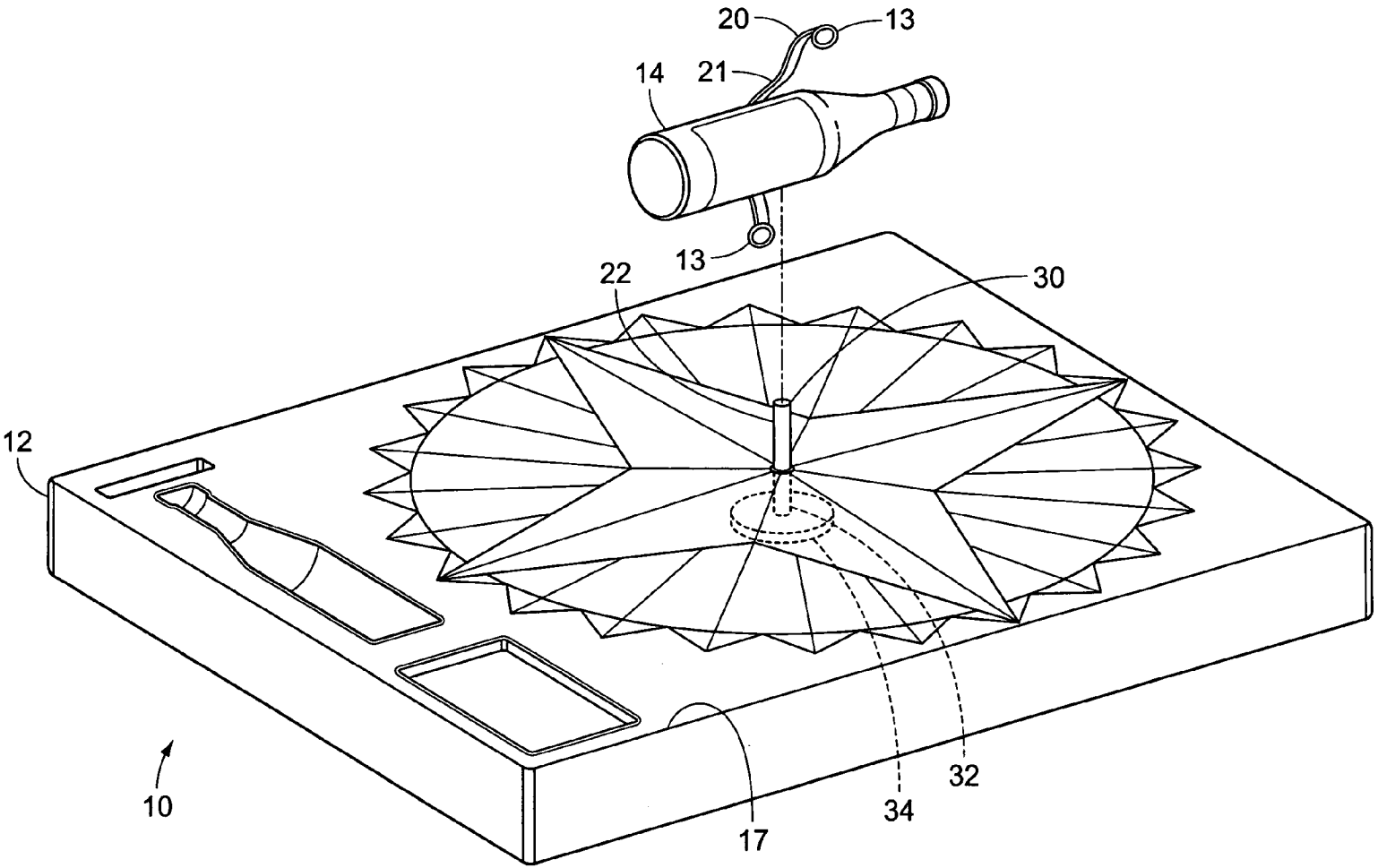
FIG. 2 is an exploded view of the rotating bottle integrally attached to the board of the present invention.

FIG. 2 illustrates a tubular base 22 centrally positioned within the large circular sun-like design of the board 12. The tubular base 22 has a top end 30 and a bottom end 32. The top end 30 of the tubular base 22 extends outwardly from the interior 17 of the board 12, while the bottom end 32 is located within interior 17 of the board 12. A metallic strap or belt 20 having two ends 21 is removably hooked at each end 21 to the top end 30 of the tubular base 22 by two hooks 13 attached to the tubular base 22. The belt 20 wraps around the bottle 14 and holds the bottle securely to the top end 30 of the tubular base 22. A circular axis 34 is located within the interior 17 of the board 12. The bottom end 32 of the tubular base 22 is swivel mounted to the axis 34 for allowing the bottle 14 to rotate thereon.

FIG. 1 illustrates a first indentation 28 in a three-dimensional shape of the bottle 14 that extends downwardly from the top surface 16 of the board 12 for storing the bottle 14 therein when not in use. A second indentation 29 extends downwardly from the top surface 16 of the board for storing the axis 34 therein.

A plurality of instructional cards 36 are included with the board game 10, which each feature a different instruction, task, dare, or obstacle to be completed by one of the players. The instructional cards 36 are substantially rectangular in shape. A third indentation 38 extends downwardly from the top surface 16 of the board for holding the instructional cards 36 therein while playing the board game 10.

In use, the players select any flat surface for setup of the board game 10. After securing the bottle 14 within the belt 20 and placing the instructional cards 36 in the third indentation 38, one starting player is selected to begin the board game 10. With a hand on the bottle 14, the one starting player spins the bottle 14. The bottle 14 rapidly rotates on the axis and slows down in velocity before stopping completely. When the bottle 14 stops, the mouth 24 of the bottle 14 is pointed to one of the players who will take a turn by completing one of the tasks on the instructional cards 36. The player to whom the tail 26 of the bottle 14 points, is charged with selecting the instructional card 36 and reading the task aloud for the player to complete. After the task on the instructional card 36 is completed, the player who completed the task spins the bottle 14, and play continues in a similar fashion.

When finished playing the board game 10, the board game 10 is easily put away, by storing the bottle 14 in the first indentation 28, and the axis 34 in the second indentation 29. The board game 10 is then stored in a compact box set, for easy transport and storage.

In conclusion, herein is presented a board game having an integrally attached rotating bottle and a plurality of instructional cards. The invention is illustrated by example in the drawing figures, and throughout the written description. It should be understood that numerous variations are possible, while adhering to the inventive concept. Such variations are contemplated as being a part of the present invention.

What is claimed is:

1. A method of playing a board game for players, having a board, an integrally attached rotating bottle, a plurality of instructional cards, an axis, and a tubular base, the board having an interior and a top surface, the top surface having a first, second, and third indentation extending downwardly therein, the tubular base having a top end and a bottom end, the top end extends outwardly from the interior of the board, while the bottom end is located within interior of the board, a belt having two ends is removably hooked at each end to the top end of the tubular base, the bottom end of the tubular base is swivel mounted to the axis, the bottle having a mouth and a tail, the steps comprising:

a) selecting any flat surface for setup of the board game;

b) setting-up the board game, by securing the bottle within the belt for wrapping around the bottle and holding the bottle securely to the top end of the tubular base, and placing the instructional cards in their place within the third indentation;

c) selecting one starting player to begin the board game by placing one hand on the bottle and spinning the bottle allowing the bottle to rapidly rotate on the axis and slow down in velocity before stopping completely; and d) taking a turn completing a task by the player who the mouth of the bottle is pointed to, by having the player to whom the tail of the bottle points select and read one of the tasks on the instructional cards for the player to complete.

2. The method of playing the board game of claim 1, further comprising the step of having the player who completed the task spin the bottle and continue playing the board game by repeating step d).

3. The method of playing the board game of claim 1, further comprising the step of putting away the board game by placing the bottle within the first indentation, and placing the axis within the second indentation.

* * * * *